US010451393B2

(12) United States Patent
Potter

(10) Patent No.: US 10,451,393 B2
(45) Date of Patent: Oct. 22, 2019

(54) ARROW FLETCHING DEVICE WITH PLATE CLAMP

(71) Applicant: BOHNING COMPANY, LTD, Lake City, MI (US)

(72) Inventor: Robert L Potter, Lake City, MI (US)

(73) Assignee: BOHNING COMPANY, LTD, Lake City, MI (US)

( * ) Notice: Subject to any disclaimer, the term of this patent is extended or adjusted under 35 U.S.C. 154(b) by 327 days.

(21) Appl. No.: 14/753,990

(22) Filed: Jun. 29, 2015

(65) Prior Publication Data

US 2016/0377393 A1 Dec. 29, 2016

(51) Int. Cl.
*B23P 19/00* (2006.01)
*F42B 33/00* (2006.01)
*F42B 6/06* (2006.01)

(52) U.S. Cl.
CPC ..... *F42B 33/001* (2013.01); *F42B 6/06* (2013.01)

(58) Field of Classification Search
CPC .. B25B 1/00; B25B 5/00; B25B 11/00; B23Q 1/00; B23Q 3/00
See application file for complete search history.

(56) References Cited

U.S. PATENT DOCUMENTS 4,387,001 A * 6/1983 Burns ..... H01B 19/00 156/495
6,702,269 B1 * 3/2004 Tadich ..... B27F 7/155 269/304
7,837,185 B2 * 11/2010 Naito ..... H01G 9/0029 269/289 R
9,199,302 B2 * 12/2015 Fusayasu ..... B21L 19/00
2016/0377393 A1 * 12/2016 Potter ..... F42B 6/06 156/293

* cited by examiner

*Primary Examiner* — Lee D Wilson
(74) *Attorney, Agent, or Firm* — Warner Norcross + Judd LLP

(57) ABSTRACT

An arrow fletching device suitable for mounting Mylar fletching vanes to the surface of an arrow. The device includes a clamp for holding the fletching in a manner that leaves a surface mounting portion of the side of the fletching exposed. Then an adhesive is applied to the exposed surface and the clamp is pressed up against the arrow to securely mount the fletching to the arrow surface. One version utilize three such clamps posited at 120 degree offsets to mount three vanes around the surface of the arrow.

10 Claims, 10 Drawing Sheets

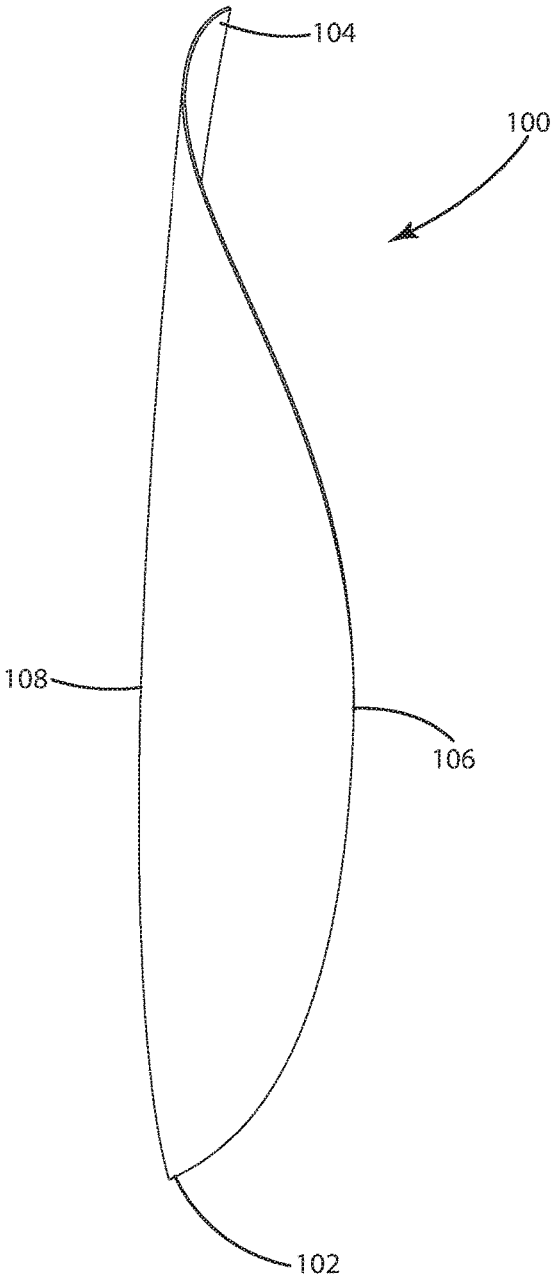
Fig. 1A
Fig. 1B
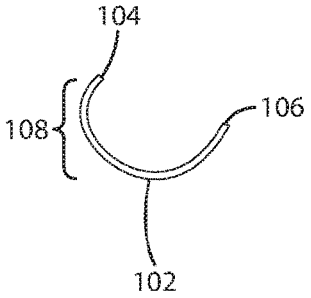

ARROW FLETCHING DEVICE WITH PLATE CLAMP

BACKGROUND

An arrow fletching, generally, is a vane-like appendage commonly found affixed, in multiples, to the aft end of an arrow shaft. The purpose of fletching is to stabilize the flight path of the arrow when shot, thereby drastically increasing an archer's accuracy and consistency over that of using an arrow without fletching. While fletching technology has certainly evolved alongside advancements in materials, arrow shaft designs, bow technologies, and so forth, the underlying concept of using a series of fletching to improve arrow flight is nothing new.

Thousands of years before Christ, archers were fashioning bird feathers onto wooden arrow shafts to gain consistent arrow flight paths. To facilitate the fashioning, they made use of materials such as sinew, catgut, and strips of hide in order to literally tie the fletching material to the arrow shaft. While today's arrows still exhibit the same time-proven form comprising a shaft with a point or load on one end and a nock and fletching on the other, modern day archers, of course, don't have to rely on the rudimentary arrow construction techniques employed by their ancestors.

Today's fletching materials of choice vary from real feather to synthetic feather to rubber, silicone and plastic. Regardless of the fletching material, however, most arrow fletching or vane designs in use today are simply glued onto an arrow shaft that is made of either aluminum or a carbon composite. In short, beyond materials and construction techniques, the overall design of a fletched arrow has changed very little in tens of thousands of years. So, what's needed in the art? A better technique of construction or attachment of the fletching to an arrow.

Arrows, and the fletching in particular, take a beating during use. Each time an arrow is released from a bow, chances are that the fletching will sustain damage from contact with previously shot arrows, targets, tree limbs, or the like. The predictable result of fletching damage is an ongoing expense for the archer. Some archers prefer to buy their arrows from an archery supplier already assembled and ready to be flung. Other archers, perhaps more particular in their preferences or, at least, more fortunate to have abundant time at their disposal, prefer to custom build their arrows. Further, an experienced archer, whether in competition or hunting, realizes that the environmental conditions, including wind, humidity, temperature, terrain, etc. can have a significant influence on the desired construction or configuration of the arrow. As such, it is unrealistic to have at the archer's disposal, an ample supply of each arrow configuration that may be required. It is these archery enthusiasts, the ones that choose to build their own arrows and/or arrows for other archers, who possess myriad devices and supplies useful for fletching, and re-fletching, arrows into an optimal configuration for the day's task.

When constructing an arrow, the positioning of fletching relative to the shaft of an arrow is critical. One simply doesn't squirt some glue down the shaft, stick some fletching on it, and then see how she flies. Rather, a fletching must be precisely positioned and then held in place while the glue dries before the arrow is repositioned for application of the next, precisely positioned fletching.

There are numerous devices known in the art that are useful when fitting an arrow with fletching. Generally, Bitzenburger describes in U.S. Pat. No. 3,330,551, as does Finlay in U.S. Pat. No. 5,211,382, a jig fitted with a spring loaded butterfly style clip that is operable to clamp a fletching and firmly position it relative to an arrow shaft while the fletching glue sets.

Variations of the butterfly clip style fletching jigs taught by Bitzenburger and Finlay are numerous in the market, but all share common shortcomings. For instance, with repeated use, the spring constant associated with the clip portion of jigs known in the art are prone to weakening such that they become unable to consistently grip fletching. Also, when placing a fletching into the spring-loaded clamp, in advance of setting the fletching to the arrow shaft, painstaking care must be taken that the fletching is positioned at the proper depth, angle and index mark within the clamp. Further, the force applied to fletching by way of the clamping force of the clip can damage the fletching as some fletching materials are fragile. Even further, the use of a clamp is generally cumbersome and inconvenient for the user. Moreover, clamp lengths may be specific to fletching lengths and fletching applications and, therefore, expensive clamps often must be swapped out each time a user changes fletching designs.

Further, a now popular fletching used for Recurve bows is the Mylar spin or curved fletching vanes. These fletching vanes pose several unique and difficult problems in mounting to the shaft of the arrow. First of all, the fletching vanes, as the name implies, are not flat but rather are naturally curled. This characteristic makes it difficult to mount to the surface of an arrow shaft as the curled edge must be attached along a straight line. In addition, this style of fletching does not include a base that mates to the arrow shaft but rather, the flat side of the fletching vane is directly attached to the arrow shaft. Further, these fletching vanes are typically attached to the shaft of the arrow using an adhesive, such as double-sided tape as a non-limiting example. The adhesive or double-sided tape must be mounted to the flat edge of the vane and then positioned at a particular location on the arrow shaft and thus, are side mounted. The typical fletching jigs on the market or not suitable for mounting this type of vane.

One technique for mounting of the Mylar spin vanes is completely accomplished manually by hand. An assembler will mark the locations on the arrow shaft for mounting of the vane, apply the double-sided adhesive to the surface of the vane and then attach the vane to the arrow shaft. This procedure is a very difficult and tedious task and, performance of this procedure in the field is even more exasperating. Other techniques that have been introduced include a jig for marking the shaft of the arrow to identify the location for application of the vanes and using a small, single vane jig to assist in holding the vane flat while the adhesive is applied thereto. The known techniques fall short of providing a comprehensive and reduced labor application of the Mylar vanes to an arrow shaft.

For all the reasons set forth above, as well as other reasons, prior art in the field of arrow fletching jigs are inadequate. Thus, there is a need in the art for a device operable to consistently and conveniently set Mylar curvy arrow fletching in a reliable manner.

BRIEF SUMMARY

An arrow fletching device that is configured to simultaneously mount a plurality of fletching vanes, such as three, Mylar vanes to the surface of an arrow shaft. In general, exemplary embodiment of the arrow fletching device or jig includes three arms, where each arm is used to hold and then secure a fletching to the surface of an arrow shaft. Each arm includes a clamp or holder into which the fletching can be inserted and held in position. Some embodiments allow for different sizes of fletching and/or the ability to move the fletching up or down within the holder to select the precise location on the arrow shaft that the user desires to affix the fletching.

Once the fletching vanes are in position, adhesive can be affixed to a mounting surface of the fletching. The arms can then be moved into position to adhere the fletching vanes to the surface of an arrow shaft.

More specifically, one embodiment of the fletching device is configured to install a side-mount fletching vane to the surface of an arrow shaft. The device or apparatus includes one or more arm assemblies that are used to hold the fletching and then force the fletching against the arrow for attachment. The arm assemblies include a table element and a clamp element. The table element includes an interface for receiving of the clamp element and once installed, the two elements cooperate to hold a fletching into position such that adhesive can be applied to a side surface of the fletching. At this point, the arm assembly can be applied to the surface of an arrow shaft thus causing the adhesive to adhere to the arrow shaft.

In some embodiments, the table element may include a side table surface and a center table surface and, the clamp element interfaces to the table element over the side table surface. Further, in some embodiments the center table surface is recessed such that when a fletching is inserted between the clamp element and the side table surface, a portion of the fletching proximate to the mounting side of the fletching extends from under the clamp element and into the recess of the center table surface. The recess includes a lip that provides support in holding the fletching in position. In addition, in a typical embodiment the center table surface is of sufficient width to receive the surface of an arrow shaft.

In some embodiments, three arm assemblies are utilized. In such embodiments, each arm assembly is mounted to a base and is rotatable between an open position and a closed position. In the closed position, the shaft of an arrow is clamped between the three arm assemblies.

Further, in such an embodiment, the arm assemblies are attached to a swivel mount and each swivel mount is attached to a sliding tray. A lever can then be used to actuate the sliding trays such that when actuated in a first direction, the sliding trays move towards the center of the base and when actuated in a second direction the sliding trays move away from the center of the base. When the arm assemblies are moved into a closed position, the lever can be actuated in a first direction to clamp the arrow with the arm assemblies.

Other embodiments may include more or less than three arm assemblies. In the three arm assemblies embodiment, the arm assemblies are oriented at 120 degree offsets from each other relative to the circumference of the arrow shaft.

In some embodiments, the arm assembly includes a left side table element and a right side table element. In such embodiments, the arm assembly is configured to receive the clamp element and hold a fletching on either side and thus allowing the fletching to be mounted for clock-wise or counter clock-wise rotation of the arrow. Thus, left or right wing vanes can be mounted in such embodiments.

Theses and other embodiments, features, aspects, etc. are presented in more detail in the detailed description and the claims.

BRIEF DESCRIPTION OF THE SEVERAL VIEWS OF THE DRAWING

FIG. 1A is a side view of an exemplary Mylar curved style fletching and FIG. 1B is an end view of the same, both collectively referred to as FIG. 1.

DETAILED DESCRIPTION

Figure 2:
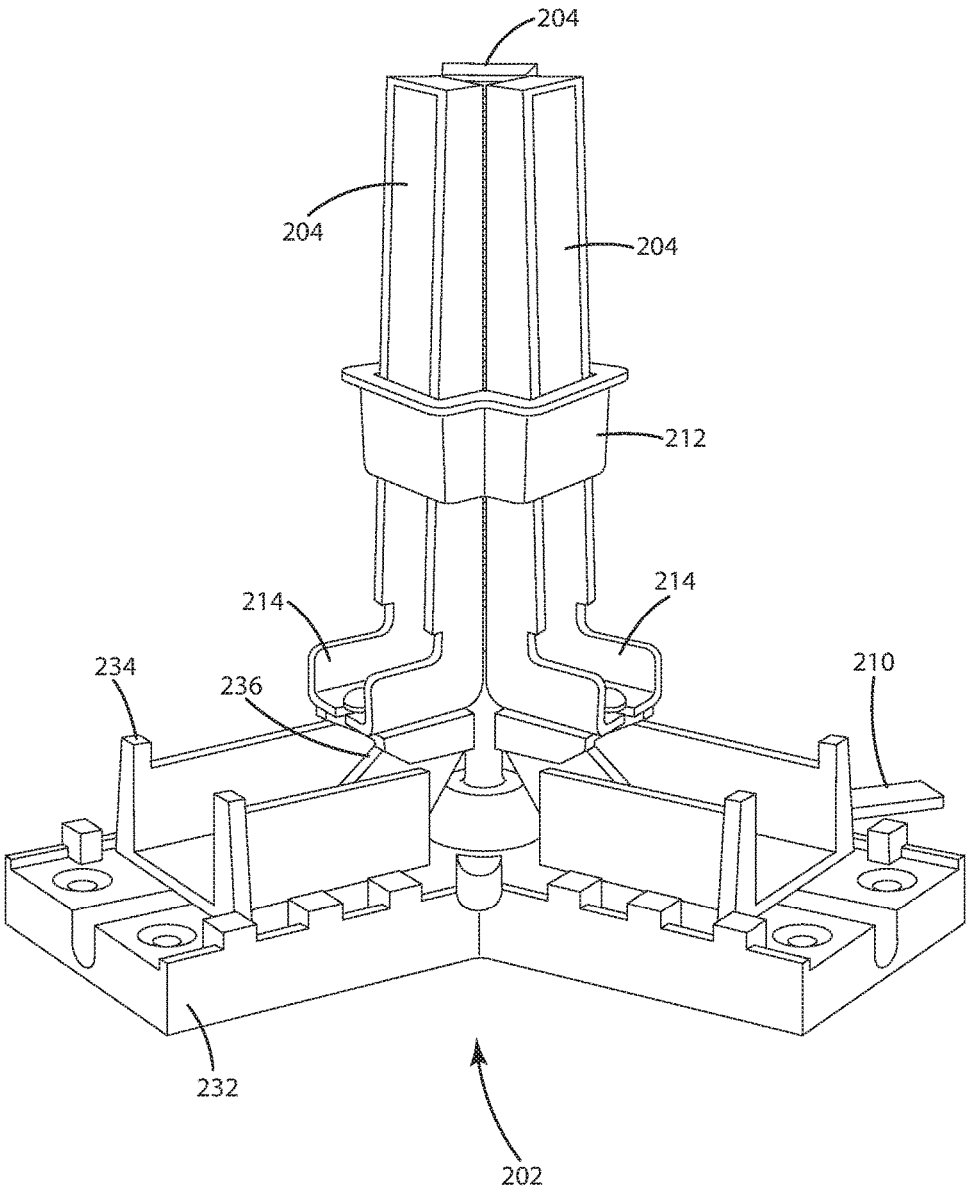
FIG. 2 presents a perspective view of an exemplary three armed fletching jig that can incorporate embodiments of the present fletching device.

The presently disclosed embodiments, as well as features and aspects thereof, are directed towards providing a device that can accurately and repeatedly position fletching against the shaft of an arrow, without a spring loaded butterfly clamp component, and securely hold the fletching thereto until a bond is attained between the fletching and arrow shaft via an adhesive.

FIG. 1A is a side view of an exemplary Mylar curved style fletching and FIG. 1B is an end view of the same, both collectively referred to as FIG. 1. The fletching 100 has a back tip 102 and a front tip 104. The back tip 102 is mounted proximate to the nock and the front tip is mounted distal from the nock. The airfoil edge 106 of the mylar fletching runs from the back tip 102 to the front tip 104. The mounting edge 108 of the mylar fletching 100 also runs from the back tip 102 to the front tip 104. As can best be ascertained from FIG. 1A, the mylar fletching is curled from back tip 102 to the front tip 104, which makes the fletching difficult to install onto the shaft of an arrow.

FIG. 2 presents a perspective view of an exemplary three armed fletching jig that can incorporate embodiments of the present fletching device. The fletching jig 200 is illustrated in a closed position or state and includes a stand 202, three arms 204, a positioning lever 210 and a slide on clamp 212. The stand 202 includes a base 232, a sliding tray 234 for each arm 204, and a swivel mount 236 for each arm 204. Actuation of the positioning lever 210 causes the sliding trays 234 to move from an open position (the sliding trays 234 move away from each other towards the distal edges of the base 232) and a closed position (the sliding trays 234 are moved proximate to each other near the center of the base 232). The arms 204 are illustrated as being mounted to the swivel mounts 236, but it should be appreciated that the arms 204 and the swivel mounts 236 may be integral pieces. In other embodiments, the arms may be mounted to a non-swiveling mount but be hinged or otherwise enabled to swivel from a closed position to an open position.

Figure 3:
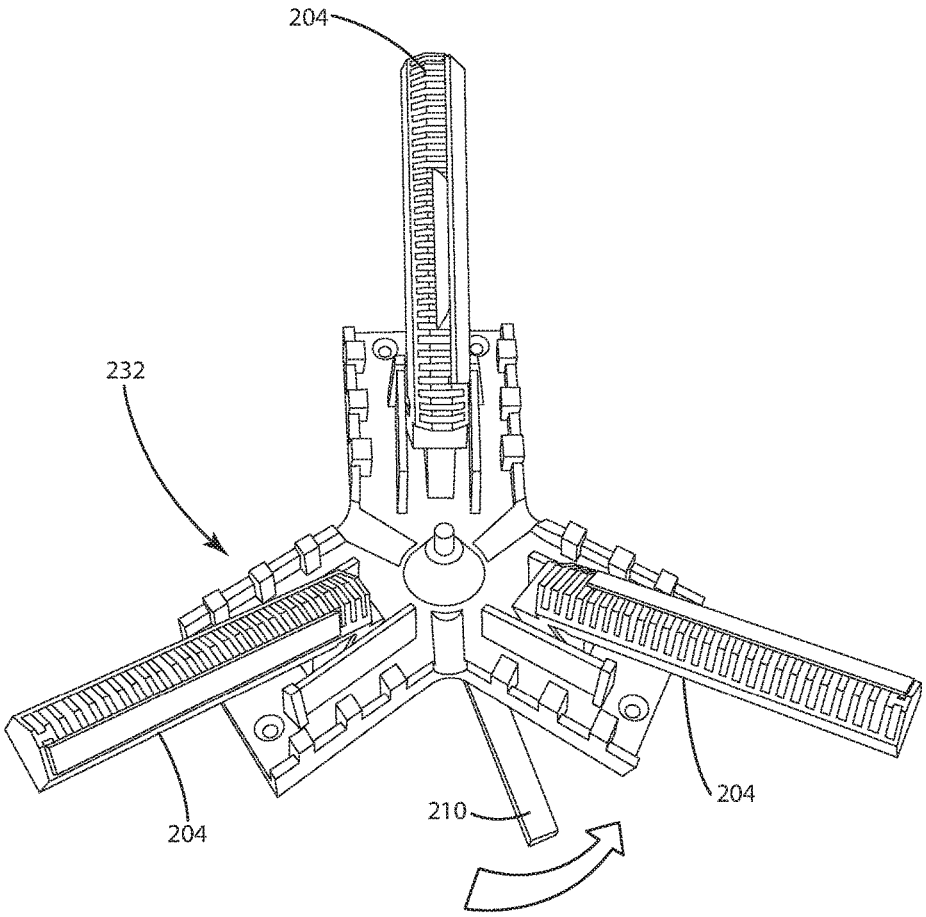
FIG. 3 presents a perspective view of the exemplary three armed fletching jig of FIG. 2 in the open state.

FIG. 3 presents a perspective view of the exemplary three armed fletching jig of FIG. 2 in the open state. In the open state, the positioning lever 210 is moved to the right position thus moving the sliding trays 234 towards the distal edge of the base 232. The slide clamp 212 has been removed thus allowing the arms 204 to swivel into the open position.

In the open position as illustrated in FIG. 3, the arms 204 can be loaded with fletching vanes and the shaft of an arrow can be inserted into the center of the stand 202. In general, once the arrow shaft is installed and the fletching vanes loaded into the arms 204, adhesive can be applied to the flat edge of the fletching. Once the adhesive is applied, the arms 204 can be swiveled upward. The positioning lever 210 may be moved to the left thereby causing the sliding trays 234 to move towards each other and toward the center of the base 232 such that the adhesive on the fletching vanes comes into contact with the surface of the arrow shaft. Finally, the slide clamp 212 can be positioned over the arms 204 and slid down, such as being gently pressed down, to apply pressure of the arms against the surface of the arrow shaft and thus, adhering the fletching vanes to the shaft.

Figure 4:
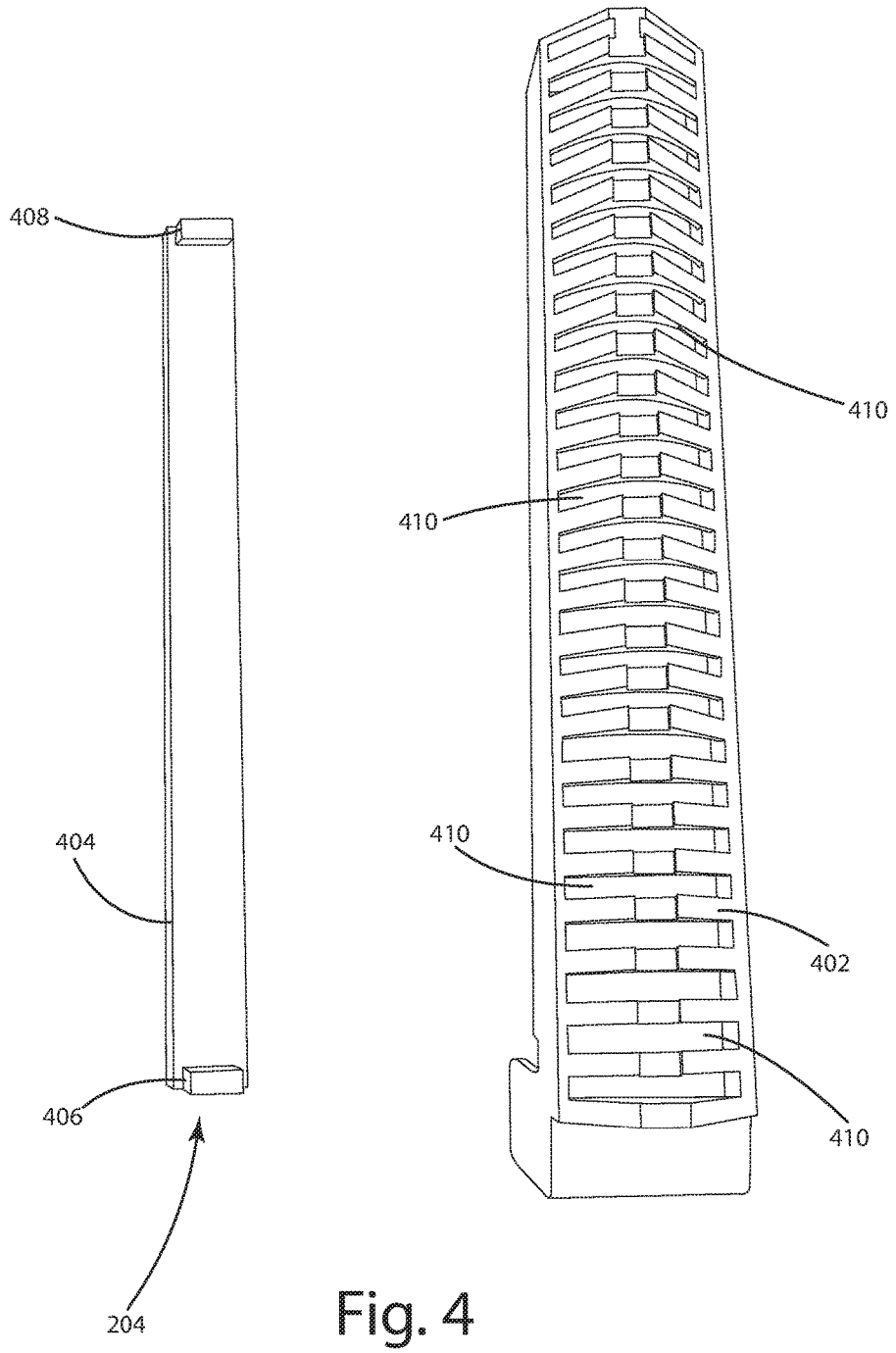
FIG. 4 is view of an unassembled arm of an exemplary fletching jig.

FIG. 4 is view of an unassembled arm of an exemplary fletching jig. The illustrated arm 204 is shown as including a table element 402 and a clamp element 404. The clamp element 404 is a rectangular shaped device with a first protrusion 406 and a second protrusion 408 located on distal ends of the clamp element 404. The protrusions (406 and 408) are configured to be slid through and clipped to the backside of the slots 410 on the surface of the table element 402. Thus, in operation, the clamp element 404 can be positioned at any point along the surface of the table element 402 and then pushed into a locked position by forcing the protrusions 406 and 408 through the slots 410 that align therewith until the clamp snaps into a locked position.

Figure 5:
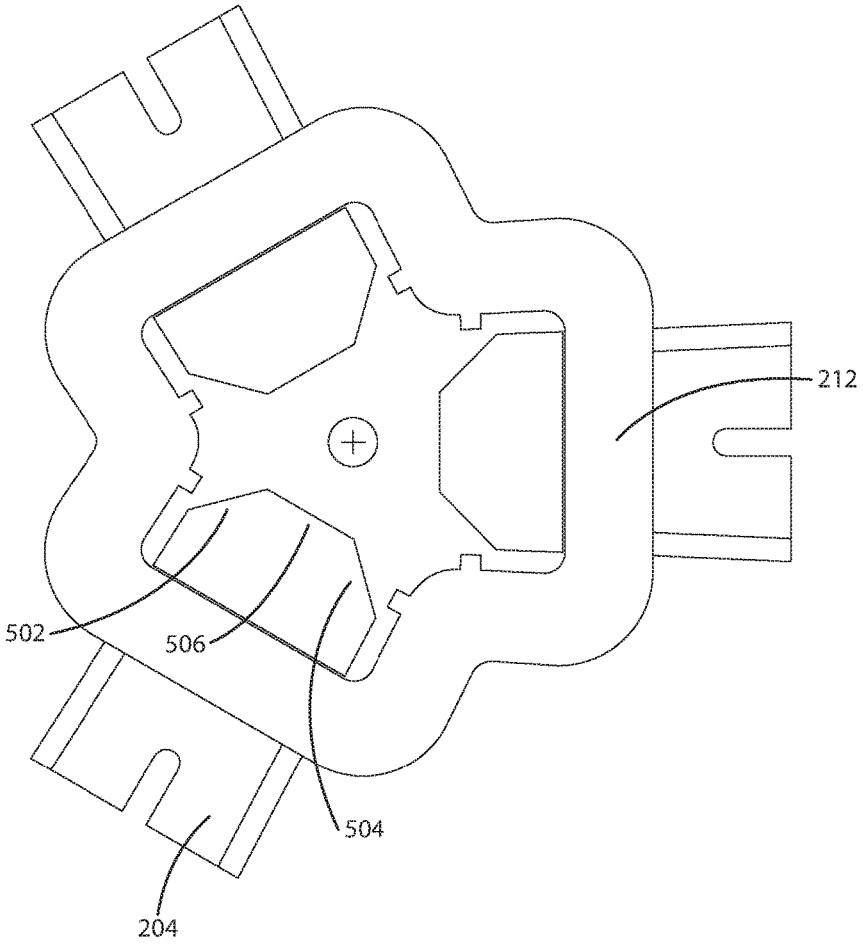
FIG. 5 is an end view of the arms of an exemplary fletching jig in the closed position.

FIG. 5 is an end view of the arms of an exemplary fletching jig in the closed position. The end view of the arms 204 shows that each arm includes a right table surface 502, a left table surface 504 and a center table surface 506. The clamp element 404 can be positioned on either the right table surface 502 or the left table surface 504 depending on whether the arrows to be fletched are for clockwise or counter-clockwise rotation.

Figure 6:
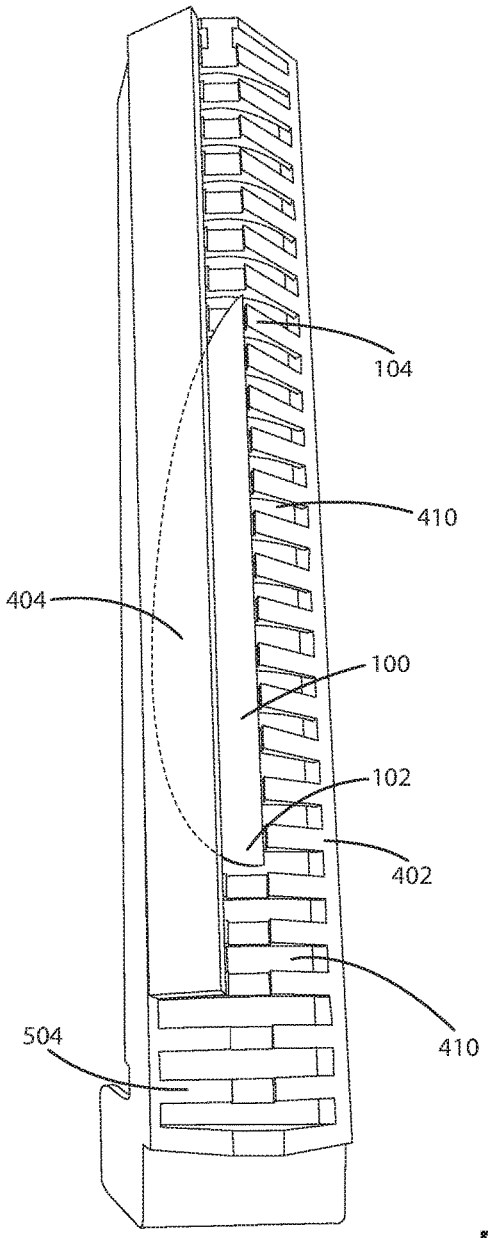
FIG. 6 is a diagram illustrating the clamp element 404 joined together with the table element 402.

FIG. 6 is a diagram illustrating the clamp element 404 joined together with the table element 402. The protrusions (406 and 408) have been pushed through two of the slots 410 of the left side table surface 504. In addition, the arm assembly 204 is illustrated as having received a fletching 100. The back tip 102 and the front tip 104 are slid up or down under the clamp element 404 until the fletching 100 is in the desired position relative to the shaft of the arrow.

Figure 7:
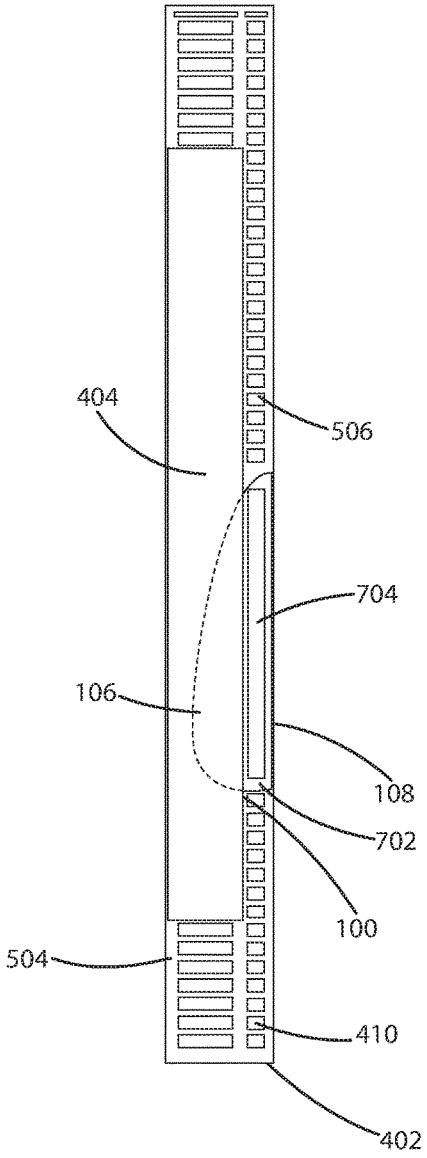
FIG. 7 is a conceptual diagram illustrating the placement of a fletching within the arm of an exemplary fletching jig.

FIG. 7 is a conceptual diagram illustrating the placement of a fletching within the arm of an exemplary fletching jig. The clamp element 404 is shown as having been positioned over the left side table 504. A fletching 100 has been loaded into the arm 204 by sliding the air-foil edge 106 between the underside of the clamp element 404 and the surface of the left side table 504. The clamp element 404 and the upper surface of the left side table 504 cooperate to hold the fletching 100 in position and maintain the fletching in a flat state. An attachment portion 702 of the fletching 100 proximate to the mounting edge 108 protrudes from under the clamp element 404 and rests on the center table surface 506. A lip on the edges of the center table surface 506 help to secure the fletching in position. A double-sided adhesive strip may then be attached to the attachment portion 702 and prepared for attachment to the arrow shaft.

It should be noted that the size of the clamp element may be different and thus, may extend the entire length of the arm 204 or, may be configured to have a length commensurate with the length of the fletching. Thus, different clamp elements may be used for different fletching lengths. In some embodiments, the clamp element may be slightly bowed to provide additional pressure against the table surface for holding the fletching in place. In other embodiments, a compressible surface, such as foam may be attached to the underside of the clamp element to provide further pressure against the table surface for securing the fletching in position. It should also be appreciated that the fletching may be slid up and down the arm 204 to a desired position along the shaft of the arrow. The slots 410 assist the user in the alignment of the fletching vanes with each other. It will be appreciated that other embodiments are also anticipated. For instance, the clamp element 404 could be replaced by an integrated slot existing within the arm 204 through which the fletching can be slid, or the clamp element could be an elastic band stretching over the surface of the arm 204. Other variations are also anticipated.

Once a fletching has been loaded into each of the arms of the exemplary fletching jig, an arrow shaft can be positioned in the center of the fletching jig. The arms 204 and swivel mounts 236 can be actuated to move the arms into a parallel position with the arrow shaft and the positioning lever 210 can be moved to the left and thus, cause the sliding trays 234 to move towards each other. The slide clamp 212 can then be slid over the arms 204 and slid down to cause pressure to be applied against the shaft of the arrow and the center table surface 506 of the arms. As a result, the adhesive 704 on the fletching vanes is pressed against the surface of the arrow and thus secured to the arrow. The sliding clamp 212 can then be removed (after a delay if an adhesive that requires setting up is utilized) and the positioning lever can be moved to the right causing the sliding trays 234 to move distal from the arrow shaft. As the arms move away from the arrow, the fletching vanes slide out from under the surface of the clamp element 404 and remain attached to the shaft of the arrow.

Figure 8:
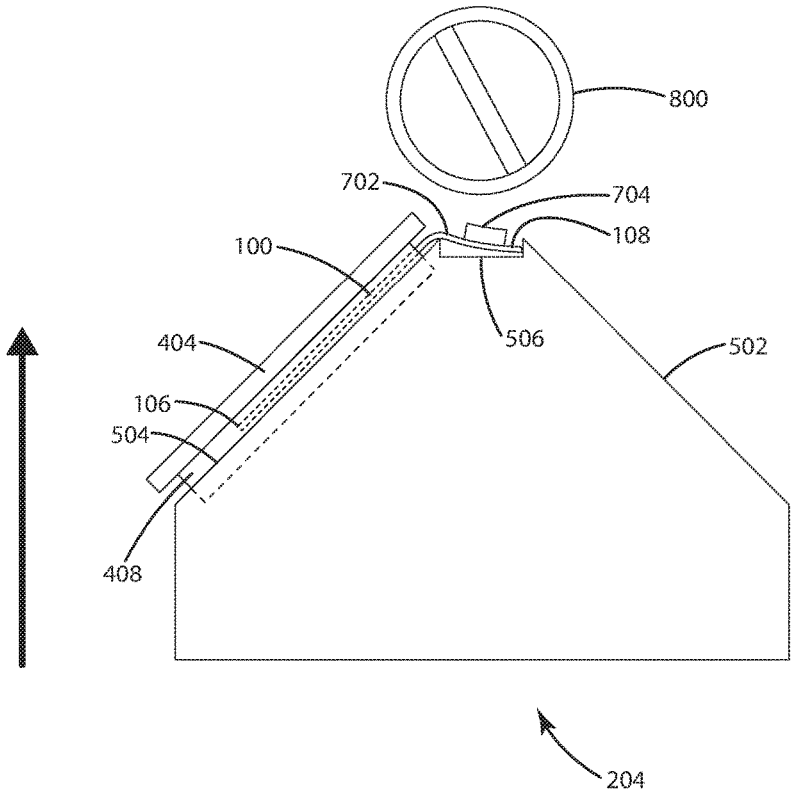
FIG. 8 is an end view showing the details of the shape of the arm assembly 204.

FIG. 8 is an end view showing the details of the shape of the arm assembly 204. The relative angle of the left side table 504 and right side table 502 is approximately 90 degrees in the illustrated embodiment. The center table 506 is smaller in width than the two side tables and it is illustrated as being indented with a flange or ridge on either side of the center table 506. The clamp element 404 is illustrated as being installed over the left side table 504 and the protrusion 408 extends through the surface of the left side table 504. The portion of the protrusion 408 that extends through the left side table 504 is shown in dotted lines as being hidden from view. The fletching 100 is inserted between the clamp element 404 and the left side table 504 such that the air-foil edge 106 is fully under the clamp element 404 and the mounting edge 108 extends out from under the clamp element 404 and into the recess of the center table 506. The portion of the fletching that is behind the protrusion 408 is shown with a dotted line. The adhesive material 704 is shown as being attached to the mounting portion of the fletching 702. An arrow shaft 800 is illustrated as being in position to receive the fletching. Thus, it will be appreciated that multiple such arms can be used to surround the arrow shaft 800 and thus apply pressure to the arrow shaft 800 for mounting of the fletching vanes. The illustrated angles are simply one embodiment and it should be appreciated that variations in the actual shape can be made without departing from the spirit and scope of the present invention.

In should also be appreciated that while the illustrated arm assemblies are shown as including a left side table and a right side table, thus allowing the fletching to be installed in either orientation, other embodiments may only include a left side table or a right side table. FIG. 7 illustrates a single sided configuration of the arm assembly. In other embodiments, the arm assembly may only include a left side or a right side table but also be configured such that the arm can be flipped over such that in one orientation it includes a left side table and in the other orientation it includes a right side table. For instance, at the point where the arm attaches to the swivel base, the arm may include a slide in holder and then the extended arm piece. Thus, the slide in holder may be configured to receive the extended arm piece in either orientation.

It will be appreciated that the illustrated arm assemblies may hold any length of fletching vane that is equal to or less than the length of the clamping element. In addition, the clamping element may hold multiple fletching vanes arranged end to end and mount them to the arrow shaft simultaneously. In other embodiments, the table surface and clamp element may be configured such that multiple fletching vanes can be stacked upon each other and thus, by applying adhesive to only the top fletching on the stack, once installed and the arrow removed, the next fletching is then available and ready for receiving the adhesive and for being mounted.

The center table helps to wedge the fletching in place and the edges of the recess prevent the fletching from sliding out and it helps to maintain the fletching in the desired alignment. Further, the width of the center table 506 is sufficient to allow the surface of the arrow shaft 800 to come into contact with the adhesive and the center table 506 applies pressure towards the arrow shaft 800 so that the adhesive 704 firmly adheres to the surface of the arrow shaft 800. When the arrow shaft 800 is moved away from the arm assembly 204, after the adhesive has been applied to the arrow shaft 800, the fletching 100 slides out from between the clamp element 404 and the left side table 504.

Figure 9:
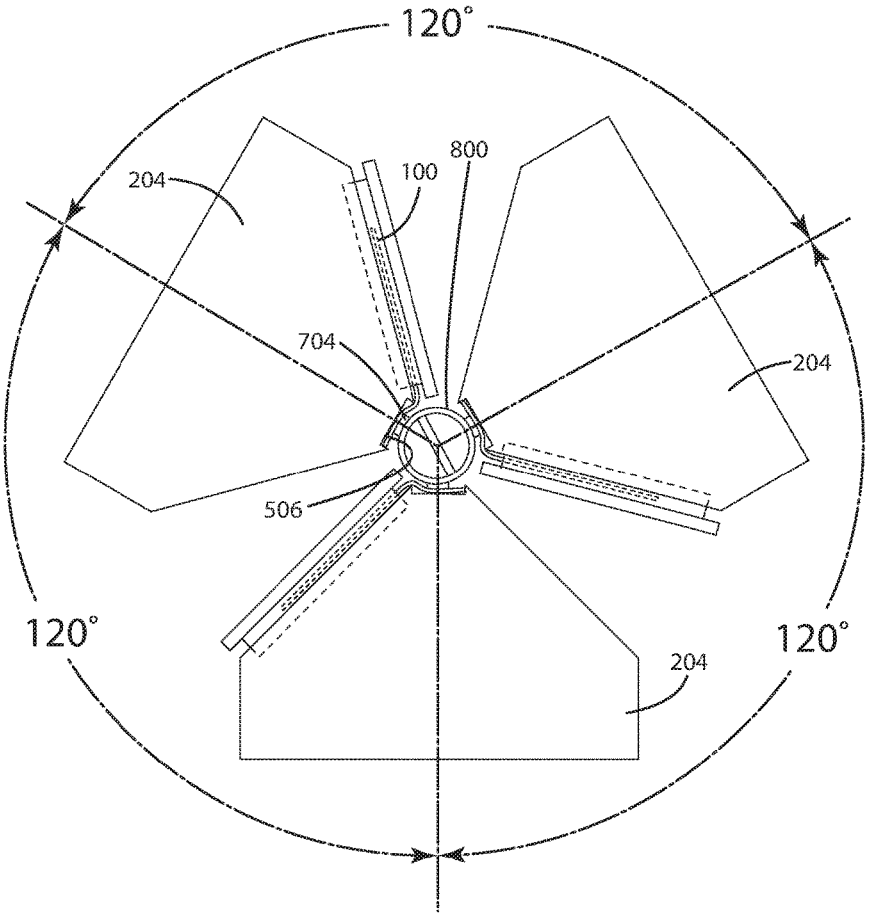
FIG. 9 is an end view of three arm assemblies, loaded with fletching vanes and being adhered to the surface of an arrow shaft.

FIG. 9 is an end view of three arm assemblies, loaded with fletching vanes and being adhered to the surface of an arrow shaft. As illustrated, the arm assemblies 204 are shown as being concentrically located around the arrow shaft 800. It will be appreciated that the illustrated embodiment shows a gap between the arm assemblies but, in various embodiments, the arm assemblies can be shaped such that the gap is reduced or increased without departing from the spirit and scope of the invention.

As illustrated, the arrow shaft 800 is situated within the midst of the center tables 506 of each arm assembly 204. As illustrated in FIG. 8 and here, adhesive 704 is located on the side surface of the fletching 100 and is situated with the adhesive side up in the center table 506 of each arm assembly. As illustrated, the arrow shaft 800 is aligned with the center tables 506 and is thus situated within the recess of the arm assembly's 204 center table 506. The slide clamp 212 (not illustrated here but shown in FIG. 2 and FIG. 5) would then be used to apply pressure to force the arm assemblies 204 toward the arrow shaft 800 and thus forcing the adhesive 704 against the surface of the arrow shaft 800, thus giving it a firm pressure to assist in the adherence of the fletching 106 to the arrow shaft 800.

In the illustrated embodiment, the arm assemblies 204 are positioned on 120 degrees orientation from each other around the shaft of the arrow 800 such that the fletching vanes are attached at the appropriate orientation. It will be appreciated that in other embodiments, more or less than three arm assemblies may be used. For instance, in one embodiment four arm assemblies may be utilized to create a four fletching bow. In such embodiments, the orientation of the arm assemblies would be at 90 degree offsets from each other and, the profile of the arm assemblies would be narrower to fit all four arm assemblies into the space. In other embodiments, less than three arm assemblies may be utilize. For instance, a single arm assembly embodiment may be used simply for replacement of damaged fletching vanes. In such an embodiment, the arrow shaft 800 may be encased in a stationary bracket that holds the arrow upright and in a desired position and, the single arm assembly can be prepared and then raised and compressed against the arrow shaft 800.

Although the various embodiments are illustrated as being in a tower configuration that stands upright, it should be appreciated that the principles of the present invention may be applied to a variety configurations of the device, including inverted, sideways oriented, etc. as non-limiting examples. In addition, rather than the arm assemblies pivoting towards and away from the arrow shaft, the arm assembles may only slide toward the shaft or may be slid down a tapering ramp towards contact with the side of the arrow shaft. In addition, spring loaded mechanisms may be used to facilitate moving the arms from an open to closed position. Further, the arms may be automatically moved between positions by the use of a gearing system driven by a motor.

It is also anticipated that the aspects of the present invention may also be utilized in an automatic, robotic production system in which the arrows, fletching and adhesives can be loaded into the arm assemblies and the jig, and the jig automatically actuated by a machine to operate the closure of the arm assemblies and application of the fletching.

Figure 10:
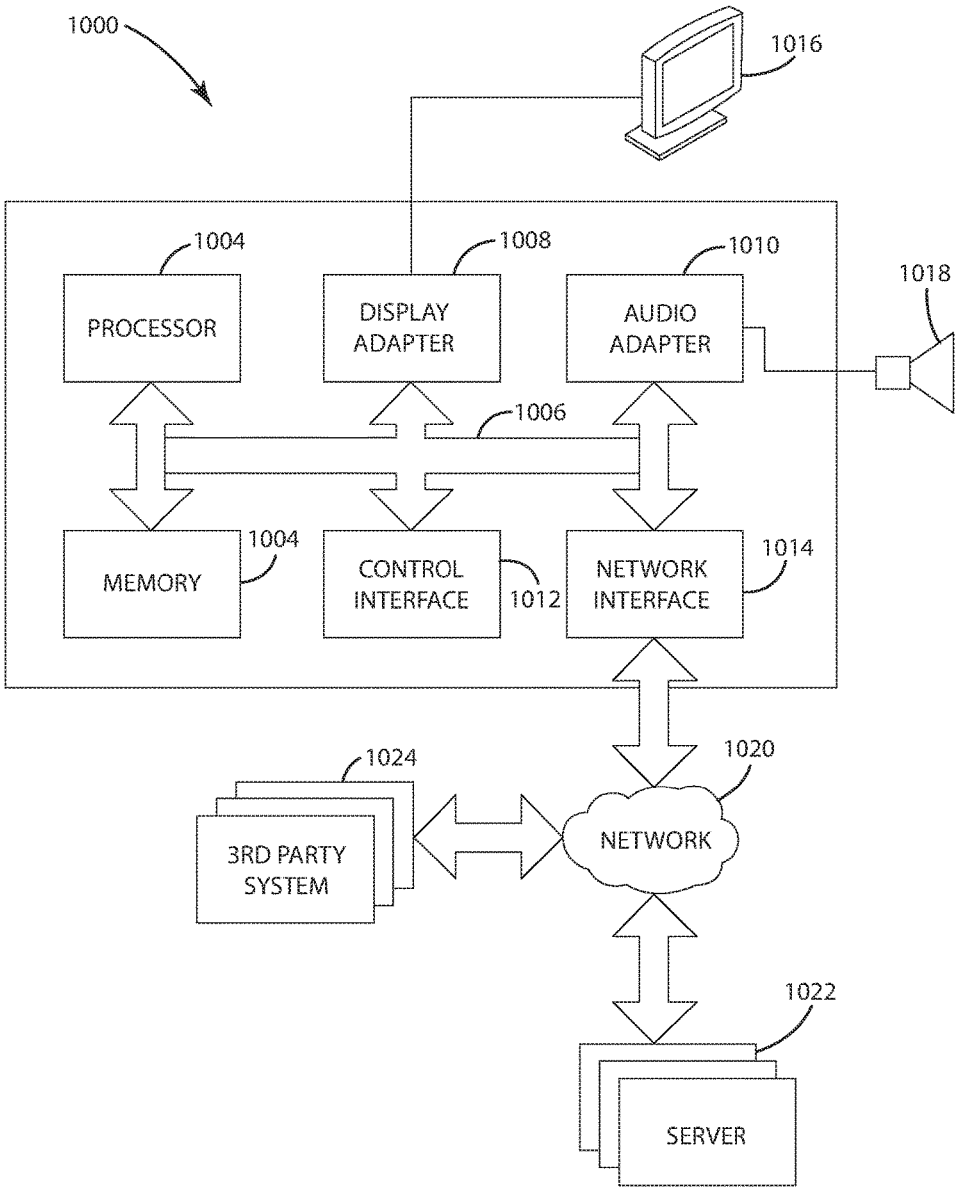
FIG. 10 is a functional block diagram of the components of an exemplary embodiment of system or sub-system operating as a controller or processor 1000 that could be used in various embodiments of the disclosure for controlling aspects of the various embodiments that are configured as automatic systems.

FIG. 10 is a functional block diagram of the components of an exemplary embodiment of system or sub-system operating as a controller or processor 1000 that could be used in various embodiments of the disclosure for controlling aspects of the various embodiments that are configured as automatic systems. It will be appreciated that not all of the components illustrated in FIG. 10 are required in all embodiments of the such automatic systems but, each of the components are presented and described in conjunction with FIG. 10 to provide a complete and overall understanding of the components. The controller can include a general computing platform 1000 illustrated as including a processor/memory device 1002/1004 that may be integrated with each other or, communicatively connected over a bus or similar interface 1006. The processor 1002 can be a variety of processor types including microprocessors, micro-controllers, programmable arrays, custom IC's etc. and may also include single or multiple processors with or without accelerators or the like. The memory element of 1004 may include a variety of structures, including but not limited to RAM, ROM, magnetic media, optical media, bubble memory, FLASH memory, EPROM, EEPROM, etc. The processor 1002, or other components in the controller may also provide components such as a real-time clock, analog to digital convertors, digital to analog convertors, etc. The processor 1002 also interfaces to a variety of elements including a control interface 1012, a display adapter 1008, an audio adapter 1010, and network/device interface 1014. The control interface 1012 provides an interface to external controls, such as sensors, actuators, drawing heads, nozzles, cartridges, pressure actuators, leading mechanism, drums, step motors, a keyboard, a mouse, a pin pad, an audio activated device, as well as a variety of the many other available input and output devices or, another computer or processing device or the like. The display adapter 1008 can be used to drive a variety of alert elements 1016, such as display devices including an LED display, LCD display, one or more LEDs or other display devices. The audio adapter 1010 interfaces to and drives another alert element 1018, such as a speaker or speaker system, buzzer, bell, etc. The network/interface 1014 may interface to a network 1020 which may be any type of network including, but not limited to the Internet, a global network, a wide area network, a local area network, a wired network, a wireless network or any other network type including hybrids. Through the network 1020, or even directly, the controller 1000 can interface to other devices or computing platforms such as one or more servers 1022 and/or third party systems 1024. A battery or power source provides power for the controller 1000.

It should be appreciated that such as system in which a processor operates based on a set of software or firmware instructions and the state of various external variables is in essence a machine in which the gears and interoperations of the machine are actually physical bits that are stored in memory components and are then used to configure the various elements, such as electronic switches in the form of transistors and other electronic circuits. As such, changing the software of such a machine is akin to changing the gearing and ratios within a clock and as such, a processor executing software instructions and monitoring the state of various inputs and controlling the state of various outputs is no different than any other machine.

The present arrow fletching jig has been described using detailed descriptions of embodiments thereof that are provided by way of example and are not intended to limit the scope of the device. The described embodiments comprise different features, not all of which are required in all embodiments of an arrow fletching device. Some embodiments of the arrow fletching device utilize only some of the features or possible combinations of the features. Variations of embodiments of an arrow fletching device that are described and embodiments of an arrow fletching device comprising different combinations of features noted in the described embodiments will occur to persons of the art.

It will be appreciated by persons skilled in the art that an arrow fletching device is not limited by what has been particularly shown and described herein above. Rather, the scope of an arrow fletching device with plate clamp is defined by the claims that follow.

What is claimed is:

1. An apparatus for installing a side-mount fletching vane to the surface of an arrow shaft, the apparatus comprising:
- a stand,
- a movable clamp;
- a position lever; and
- three arm assemblies rotatably mounted to the stand and operative to rotate between an open position and a closed position, each arm assembly including:
  - a table element with a recessed center table surface; and
  - a clamp element, wherein the clamp element is configured to join with the table element in at least one of a plurality of locations and wherein the clamp element and the table element cooperate to hold a fletching there between with a side surface of the fletching being aligned with the recessed center table surface such that adhesive can be applied to the side surface of the fletching;
- wherein the position lever is operable, when actuated, to move the three arm assemblies from the open position to the closed position, wherein in the closed position, the arms rotate such that the table elements of the arm assemblies are parallel to each other and force the respective recessed center table surfaces of the respective table elements toward the shaft of an arrow positioned there between.

2. The apparatus of claim 1,
- wherein each of the table elements includes a side table surface and the recessed center table surface,
- wherein each of the respective clamp elements interface with the respective table elements over the side table surface.

3. The apparatus of claim 2, wherein a portion of the fletching proximate to the side surface of the fletching extends from under the clamp element and into the recess of the center table surface.

4. The apparatus of claim 3, wherein the recessed center table surface includes a lip that provides support in holding the fletching in position.

5. The apparatus of claim 4, wherein the recessed center table surface is of sufficient width to receive the surface of an arrow shaft.

6. The apparatus of claim 1, wherein the arm assemblies are oriented at 120 degree offsets from each other.

7. The apparatus of claim 1, wherein each arm assembly includes a left side table element and a right side table element, either configured to receive the clamp element and hold a fletching.

8. The apparatus of claim 1,
- wherein each arm assembly includes a left side table element and a right side table element and both are configured to receive the clamp element and hold a fletching.

9. An apparatus for installing a side-mount fletching vane to the surface of an arrow shaft, the apparatus comprising:
- three arm assemblies with each arm assembly comprising:
  - a table element; and
  - a clamp element,
- wherein the table element and the clamp element cooperate to hold a fletching in position such that adhesive can be applied to a side surface of the fletching and then the three arm assemblies can be applied toward a surface of an arrow shaft thus causing the adhesive to adhere to the arrow shaft,
- wherein each table element includes a side table surface and a center table surface,
- wherein each respective clamp element interfaces with each respective table element over the side table surface.

10. The apparatus of claim 9,
- wherein each center table surface defines a recess, and
- wherein the fletching is configured to be inserted between the clamp element and the side table surface,
- wherein a portion of the fletching proximate to the side surface of the fletching extends from under the clamp element and into the recess of the center table surface.

* * * * *